US010864723B2

(12) United States Patent
Sugiura

(10) Patent No.: US 10,864,723 B2
(45) Date of Patent: Dec. 15, 2020

(54) LIQUID EJECTION APPARATUS AND LIQUID SUPPLY UNIT

(71) Applicant: BROTHER KOGYO KABUSHIKI KAISHA, Nagoya (JP)

(72) Inventor: Keita Sugiura, Toyoake (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 15/452,964

(22) Filed: Mar. 8, 2017

(65) Prior Publication Data

US 2018/0086093 A1 Mar. 29, 2018

(30) Foreign Application Priority Data

Sep. 29, 2016 (JP) ..... 2016-190947

(51) Int. Cl.
*B41J 2/055* (2006.01)
*B41J 2/175* (2006.01)
*B41J 2/18* (2006.01)

(52) U.S. Cl.
CPC ..... *B41J 2/055* (2013.01); *B41J 2/175* (2013.01); *B41J 2/18* (2013.01); *B41J 2/17596* (2013.01); *B41J 2202/20* (2013.01)

(58) Field of Classification Search
CPC ..... B41J 2/055
USPC ..... 347/94
See application file for complete search history.

(56) References Cited

U.S. PATENT DOCUMENTS 6,695,495 B1 * 2/2004 White ..... B41J 2/22 101/93.04
8,277,036 B2 10/2012 Takata
2002/0057972 A1 * 5/2002 Barinaga ..... B41J 2/17596 417/413.3
2007/0120904 A1 * 5/2007 Sekiguchi ..... B41J 2/055 347/85
2009/0102899 A1 * 4/2009 Rutten ..... B41J 2/055 347/85
2010/0073446 A1 3/2010 Shimizu
2010/0085396 A1 * 4/2010 Yokota ..... B41J 2/14233 347/7
2011/0316942 A1 12/2011 Koyama
(Continued)

FOREIGN PATENT DOCUMENTS

CN 103153625 A 6/2013
JP 09011496 A * 1/1997 ..... B41J 2/175
(Continued)

OTHER PUBLICATIONS

Machine generated English translation of JPH09011496 to Takada, "Ink Jet Recorder and Ink Discharge Recovering Method Therefore"; translation retrieved via www.espace.net on Apr. 16, 2020; 25pp.*
Extended European search report issued in the European patent application No. 17160177.6 dated Aug. 22, 2017.
Notification of First Office Action issued in corresponding Chinese Patent Application No. 201710164790.0, dated Mar. 19, 2020.
Office Action issued in corresponding European Patent Application No. 17160177.6, dated Oct. 13, 2020.
(Continued)

*Primary Examiner* — Shelby L Fidler
(74) *Attorney, Agent, or Firm* — Merchant & Gould P.C.

(57) ABSTRACT

A liquid ejection apparatus includes: an ejection module; a supply chamber connected to the ejection module and to a tank configured to store liquid; and a damper chamber connected to the supply chamber. The supply chamber has: a first opening communicating with the damper chamber; and a second opening communicating with the tank.

15 Claims, 12 Drawing Sheets

(56) References Cited

U.S. PATENT DOCUMENTS

| | | | | |
|---|---|---|---|---|
| 2013/0002772 | A1* | 1/2013 | Hiratsuka | B41J 2/16526 347/85 |
| 2013/0169710 | A1* | 7/2013 | Keefe | B41J 2/175 347/17 |
| 2014/0043382 | A1 | 2/2014 | Tamaki | |
| 2014/0063088 | A1 | 3/2014 | Shibata | |
| 2015/0174897 | A1 | 6/2015 | Arimoto | |
| 2015/0258806 | A1* | 9/2015 | Kamo | B41J 2/14233 347/92 |
| 2015/0375520 | A1* | 12/2015 | Arimoto | G01L 27/002 347/6 |
| 2016/0279938 | A1* | 9/2016 | Takino | B41J 2/14233 |
| 2017/0057241 | A1* | 3/2017 | Ueda | B41J 2/17596 |

FOREIGN PATENT DOCUMENTS

| | | | |
|---|---|---|---|
| JP | 2007-313806 | A | 12/2007 |
| JP | 2012-25036 | A | 2/2012 |
| JP | 2014-46515 | A | 3/2014 |
| JP | 2014-46577 | A | 3/2014 |

OTHER PUBLICATIONS

Office Action issued in corresponding Japanese Patent Application No. 2016-190947, dated Sep. 29, 2020.

* cited by examiner

LIQUID EJECTION APPARATUS AND LIQUID SUPPLY UNIT

CROSS REFERENCE TO RELATED APPLICATION

The present application claims priority from Japanese Patent Application No. 2016-190947, which was filed on Sep. 29, 2016, the disclosure of which is herein incorporated by reference in its entirety.

BACKGROUND

The following disclosure relates to a liquid ejection apparatus and a liquid supply unit.

There is known a liquid ejection apparatus in the form of a printer including an ink-jet head having a plurality of ejection modules. Specifically, this printer includes: the ejection modules; a supply liquid passage for supplying ink to the ejection modules; a tank storing the ink to be supplied to the supply liquid passage; and a damper chamber disposed between the supply liquid passage and the tank and configured to relieve changes of ink pressure. That is, the tank, the damper chamber, the supply liquid passage, and the head are arranged in series. The damper chamber is covered with a thin flexible film. Changes of the ink pressure during printing displace the flexible film, thereby relieving the changes of the ink pressure.

SUMMARY

The flexible film permits passage of gas therethrough. Thus, water in the ink vaporizes during, e.g., waiting, which may easily lead to increase in viscosity of the ink in the damper chamber. Also, air bubbles are easily generated because outside air enters the damper chamber by passing through the flexible film. In the above-described liquid ejection apparatus, the tank, the damper chamber, and the ejection modules are arranged in series. Thus, all the ink in the damper chamber is supplied to the ejection modules in printing. Accordingly, the high-viscosity ink and the air bubbles may flow into the ejection modules, leading to failure of ink ejection from the nozzles, for example.

Accordingly, an aspect of the disclosure relates to a technique of preventing high-viscosity liquid and air bubbles generated in a damper chamber from flowing into the ejection module.

In one aspect of the disclosure, a liquid ejection apparatus includes: an ejection module; a supply chamber connected to the ejection module and to a tank configured to store liquid; and a damper chamber connected to the supply chamber. The supply chamber has: a first opening communicating with the damper chamber; and a second opening communicating with the tank.

In another aspect of the disclosure, a liquid ejection apparatus includes: an ejection module; a first supply chamber connected to the ejection module and to a first tank configured to store first liquid; a first damper chamber connected to the first supply chamber; a second supply chamber connected to the ejection module and to a second tank configured to second liquid; and a second damper chamber connected to the second supply chamber. Each of the first supply chamber, the second supply chamber, the first damper chamber, and the second damper chamber is elongated in the first direction as a longitudinal direction. The first supply chamber has: a first opening communicating with the first damper chamber; and a second opening communicating with the first tank. The second supply chamber has: a third opening communicating with the second damper chamber; and a fourth opening communicating with the second tank. At least a portion of a wall defining the first damper chamber is constituted by a first resin film. At least a portion of a wall defining the second damper chamber is constituted by a second resin film. The first supply chamber and the first damper chamber overlap each other when viewed in an up and down direction. The first supply chamber and the second supply chamber are arranged in an arrangement direction orthogonal to each of the longitudinal direction and the up and down direction. The first damper chamber and the second damper chamber overlap each other when viewed in the up and down direction.

In yet another aspect of the disclosure, a liquid supply unit includes: a supply chamber connected to the ejection module and to a tank configured to store liquid; and a damper chamber connected to the supply chamber. The supply chamber has: a first opening communicating with the tank; and a second opening communicating with the damper chamber.

BRIEF DESCRIPTION OF THE DRAWINGS

The objects, features, advantages, and technical and industrial significance of the present disclosure will be better understood by reading the following detailed description of the embodiment, when considered in connection with the accompanying drawings, in which.

DETAILED DESCRIPTION OF THE EMBODIMENT

Figure 1:
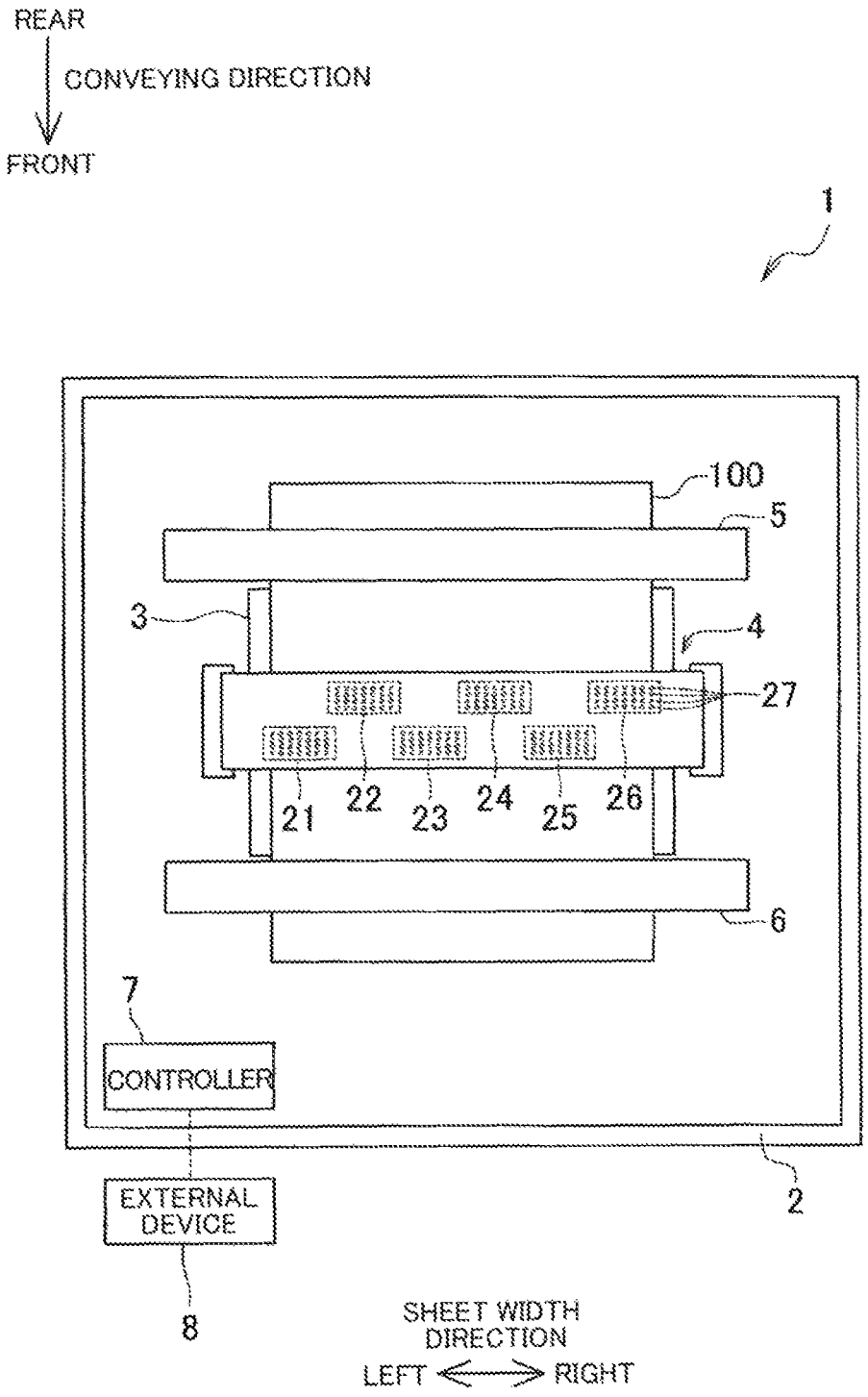
FIG. 1 is a schematic plan view of a printer according to the present embodiment.

Hereinafter, there will be described one embodiment by reference to the drawings. The direction in which a recording sheet 100 is conveyed in FIG. 1 is defined as the front and rear direction of the printer 1. The widthwise direction of the recording sheet 100 is defined as the right and left direction of the printer 1. The direction orthogonal to the front and rear direction and the right and left direction and perpendicular to the sheet surface of FIG. 1 is defined as the up and down direction of the printer 1.

Overall Configuration of Printer

As illustrated in FIG. 1, the printer 1 includes a housing 2 that contains a platen 3, an ink-jet head 4, two conveying rollers 5, 6, and a controller 7.

An upper surface of the platen 3 supports the recording sheet 100. The conveying rollers 5, 6 are respectively disposed at a rear of and in front of the platen 3. The conveying rollers 5, 6 are rotated by a motor, not illustrated, to convey the recording sheet 100 frontward on the platen 3.

The ink-jet head 4 is disposed above the platen 3 and extends throughout the entire width of the recording sheet 100 in the right and left direction. Inks of four colors, namely, yellow, cyan, magenta, and black are supplied to the ink-jet head 4 respectively from main tanks 11, which will be described below. Detail construction of the ink-jet head 4 will be described later.

The controller 7 includes a central processing unit (CPU), a read only memory (ROM), a random access memory (RAM), and an application-specific integrated circuit (ASIC) including various kinds of control circuits. The controller 7 further includes a non-transitory memory configured to store control parameters rewritably. The controller 7 is connected to an external device 8 such as a personal computer (PC) for data communication. The controller 7 controls devices of the printer 1, such as the ink-jet head 4 and the motor, based on image data transmitted from the external device 8.

More specifically, the controller 7 controls the motor such that the conveying rollers 5, 6 convey the recording sheet 100 in the conveying direction. During this control, the controller 7 controls the ink-jet head 4 to eject the ink onto the recording sheet 100 to form an image on the recording sheet 100.

Configurations of Ink-Jet Head and Components Connected Thereto

Figure 2:
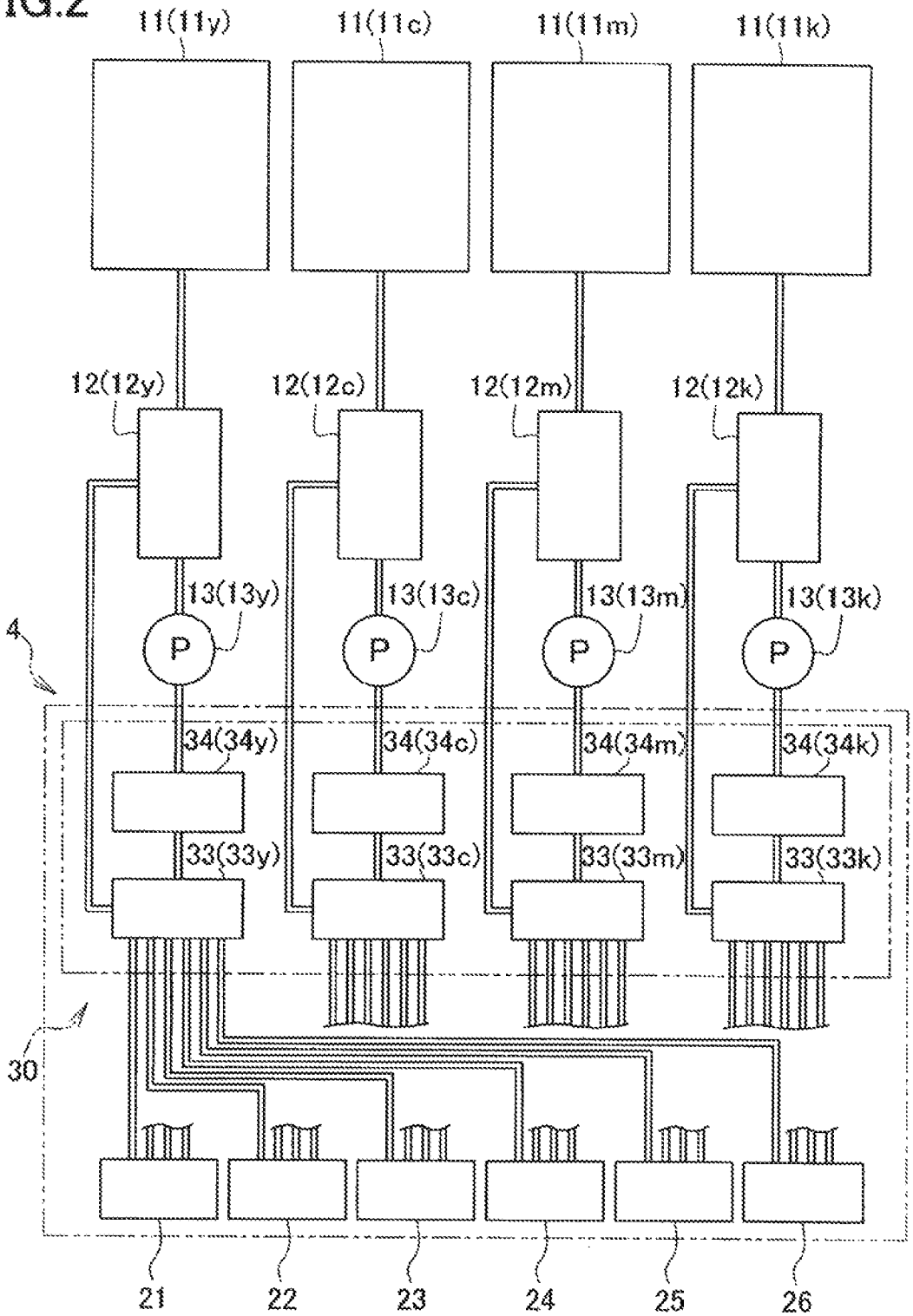
FIG. 2 is a view illustrating ink passages for four colors which are formed between an ink-jet head and main tanks.
Figure 3:
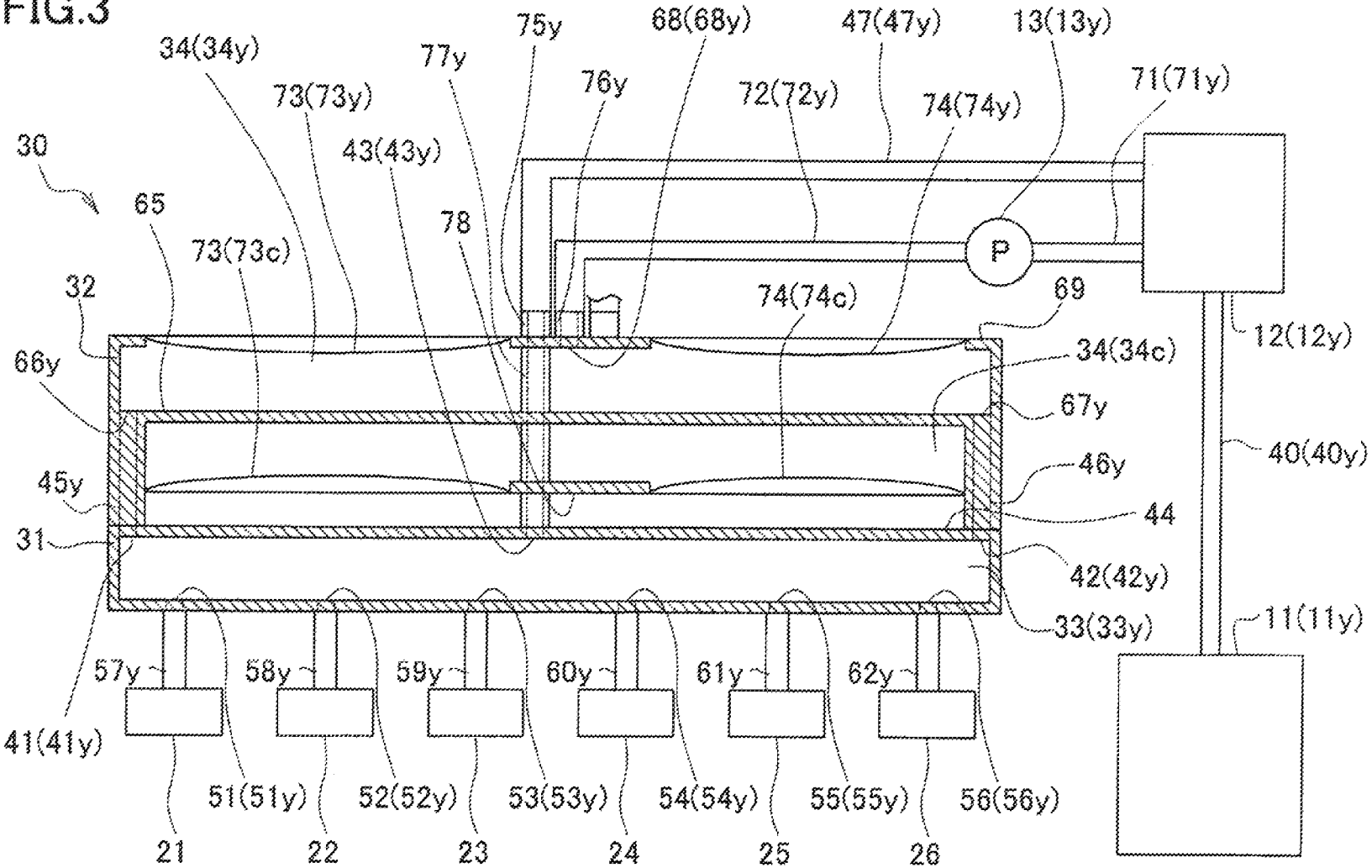
FIG. 3 is a view illustrating ejection modules and an ink passage for one color.

There will be next explained the ink-jet head 4 and components connected thereto with reference to FIGS. 1-3. FIG. 2 schematically illustrates ink passages for the four colors between the ink-jet head 4 and the main tanks 11. FIG. 3 principally illustrates a passage for yellow ink by way of example. It is noted that FIG. 3 includes: a cross-sectional view of an ink supply unit 30, which will be described below, taken along a plane orthogonal to the front and rear direction; and schematic views of the other components.

As illustrated in FIG. 2, the ink-jet head 4 includes six ejection modules 21-26 and the ink supply unit 30 configured to supply the inks to the ejection modules 21-26. The inks are supplied to the ink-jet head 4, from the respective main tanks 11 for the four colors, via respective sub-tanks 12 configured to temporarily store the respective inks. It is noted that each of the sub-tanks 12 and the ink-jet head 4 are connected to each other by two passages. A corresponding one of diaphragm pumps 13 is provided on one of the two passages. The diaphragm pump 13 is configured to circulate the ink between the ink-jet head 4 and the sub-tank 12. Detailed connection of these components will be described later.

Detailed Construction of Ink-Jet Head 4

There will be next explained the construction of the ink-jet head 4 in detail. As described above, the ink-jet head 4 includes the ejection modules 21-26 and the ink supply unit 30. As illustrated in FIG. 1, the six ejection modules 21-26 are arranged in a staggered configuration. The ejection modules 22, 24, 26 are arranged in a row in the right and left direction, and the ejection modules 21, 23, 25 are arranged in a row in the right and left direction. Each of the ejection modules 21, 23, 25 is located on a front right side of a corresponding one of the ejection modules 22, 24, 26. Each of the ejection modules 21-26 has four nozzle rows 27 respectively corresponding to the four colors and ejects the inks of the respective four colors.

As illustrated in FIG. 3, the ink supply unit 30 includes a supply member 31 and a damper member 32. The supply member 31 has the four supply chambers 33. Each of the supply chambers 33 is defined for supplying the ink to the ejection modules 21-26. In the following description, one of suffixes y, c, m, and k may be selectively added as needed to the reference numbers of components to indicate their respective correspondences with one of the yellow, cyan, magenta, and black inks. For example, the supply chamber 33 for the yellow ink may be referred to as "supply chamber 33*y*". It is noted that the supply chamber 33 for the yellow ink may be referred to as "yellow supply chamber 33*y*".

The construction of the supply member 31 will be described with reference to FIGS. 3-5. The supply member 31 has a substantially rectangular parallelepiped shape and defines therein the four supply chambers 33. As illustrated in FIG. 5A, the supply chamber 33*y*, 33*c*, 33*m*, 33*k* each extending in the right and left direction are arranged in the front and rear direction. In the case where the width of the supply member 31 in the front and rear direction is defined as W1, and the width of the yellow supply chamber 33*y* in the front and rear direction is defined as W1*y*, the width W1*y* is about one fourth of the width W1.

The yellow supply chamber 33*y* will be described by way of example. As illustrated in FIGS. 3 and 5A, the yellow supply chamber 33*y* has openings 41*y*-43*y*. The openings 41*y*, 42*y* are respectively formed in left and right end portions of an upper wall defining the supply chamber 33*y*, i.e., an upper wall 44 of the supply member 31. The opening 43*y* is formed in the upper wall 44 at its substantially central portion in the right and left direction.

The supply chamber 33*y* has openings 51*y*-56*y*. The openings 51*y*-56*y* are formed in the supply chamber 33*y* so as to be arranged in the right and left direction. The openings 51*y*-56*y* respectively communicate with the ejection modules 21-26 through the tubes 57*y*-62*y*, for example. The left three openings 51*y*-53*y* are formed between the opening 41*y* and the opening 43*y* in the right and left direction. The right three openings 54*y*-56*y* are formed between the opening 42*y* and the opening 43*y* in the right and left direction. The supply chamber 33*y* is covered with the wall except the openings 41*y*-43*y* and the openings 51*y*-56*y*.

The area of the supply chamber 33*y* in cross section orthogonal to the right and left direction at a region located between the opening 43*y* and each of the openings 51*y*-56*y* in the right and left direction is greater than the area of each of the openings 41*y*, 42*y*. In the present embodiment, the above-described cross-sectional area is greater than the area of each of the openings 41*y*, 42*y* at a region located between the opening 51*y* and the opening 56*y* in the right and left direction. The opening 51*y* and the opening 56*y* are the furthest pair among the openings 51*y*-56*y*, and the opening 43*y* is interposed between the opening 51*y* and the opening 56*y* in the right and left direction.

The constructions of the respective supply chambers 33*c*, 33*m*, 33*k* are similar to that of the supply chamber 33*y*. For example, the supply chamber 33*c* has openings 41*c*-43*c*, the supply chamber 33*m* has openings 41*m*-43*m*, and the supply chamber 33*k* has openings 41*k*-43*k*.

There will be next explained the construction of the damper member 32 with reference to FIGS. 3-5B. The damper member 32 has a substantially rectangular parallelepiped shape and defines therein four damper chambers 34.

Each of the damper chambers 34 relieves changes of a pressure of the ink in a corresponding one of the supply chambers 33. Each of the damper chambers 34 extends in the right and left direction. The length of the damper member 32 in the right and left direction is substantially equal to that of the supply member 31 in the right and left direction. The width W2 of the damper member 32 in the front and rear direction is substantially equal to the width W1 of the supply member 31 in the front and rear direction.

The damper member 32 is superposed on the supply member 31. That is, the four damper chambers 34 are located above the four supply chambers 33.

As illustrated in FIG. 3, the damper member 32 is partitioned into upper and lower portions by an inner wall 65 extending in the right and left direction. As illustrated in FIGS. 4 and 5B, the damper member 32 is also partitioned into front and rear portions. In the present embodiment, the damper chamber 34*y* and the damper chamber 34*c* overlap each other in the up and down direction, and the damper chamber 34*m* and the damper chamber 34*k* overlap each other in the up and down direction. The damper chamber 34*y* and the damper chamber 34*m* are arranged in the front and rear direction. The damper chamber 34*c* and the damper chamber 34*k* are arranged in the front and rear direction under the damper chamber 34*y* and the damper chamber 34*m*. The damper chamber 34*y* and the supply chamber 33*y* overlap each other in the up and down direction. The width W2*y* of the damper chamber 34*y* in the front and rear direction is half of the width W2. The width W2*y* is about twice the width W1*y*.

The damper chamber 34*y* will be described by way of example. As illustrated in FIG. 3, the damper chamber 34*y* has openings 66*y*-68*y*. The opening 66*y* is formed in a left end portion of the inner wall 65, and the opening 67*y* is formed in a right end portion of the inner wall 65. Communication passages 45*y*, 46*y* extend downward from the respective openings 66*y*, 67*y*. The opening 68*y* is formed in an upper wall 69 of the damper member 32 at its substantially central portion in the right and left direction.

The upper wall 69 defining the damper chamber 34*y* is partly constituted by resin films 73*y*, 74*y*. The resin films 73*y*, 74*y* are hatched in FIGS. 4 and 5B. When the pressure of the ink in the supply chamber 33*y* rises, the resin films 73*y*, 74*y* are deformed so as to protrude, which relieves the rise in the pressure. When the pressure lowers, the resin films 73*y*, 74*y* are deformed so as to be recessed, which relieves the lowering of the pressure.

Figure 4:
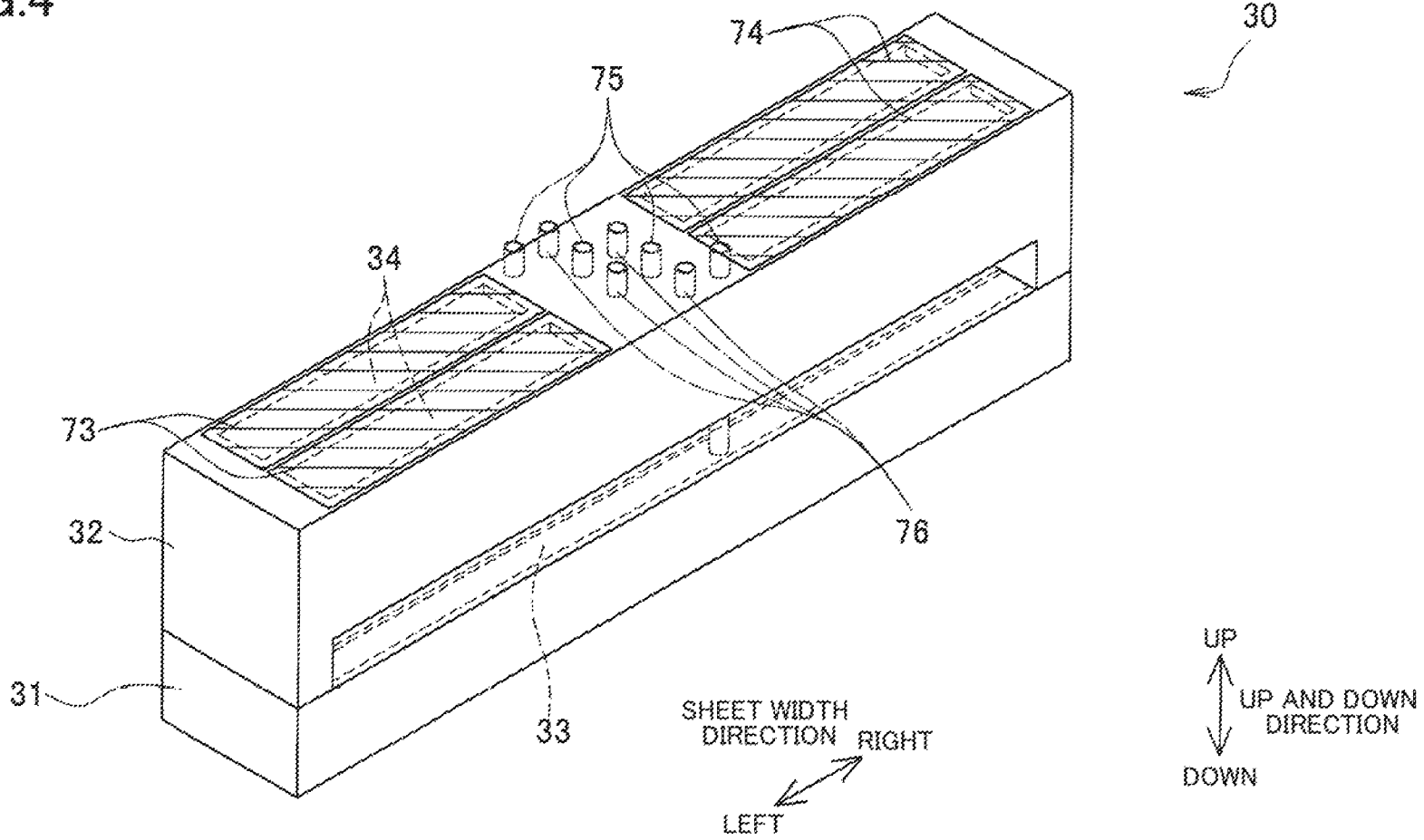
FIG. 4 is a perspective view of an ink supply unit.
Figure 5A:
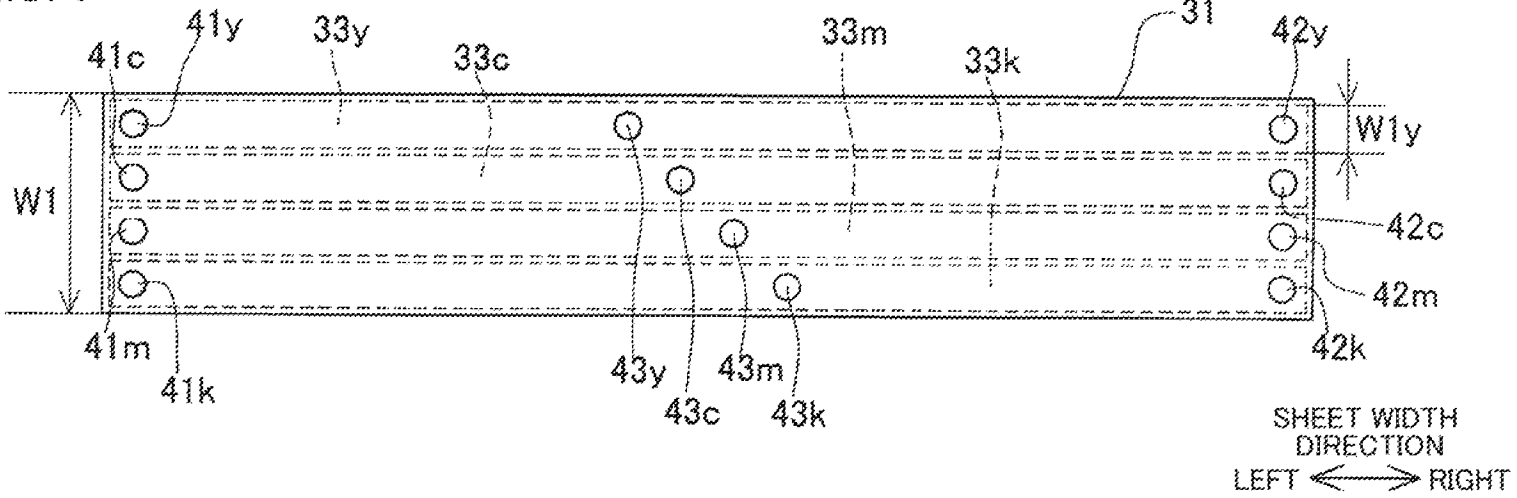
FIG. 5A is a plan view of a supply member.
Figure 5B:
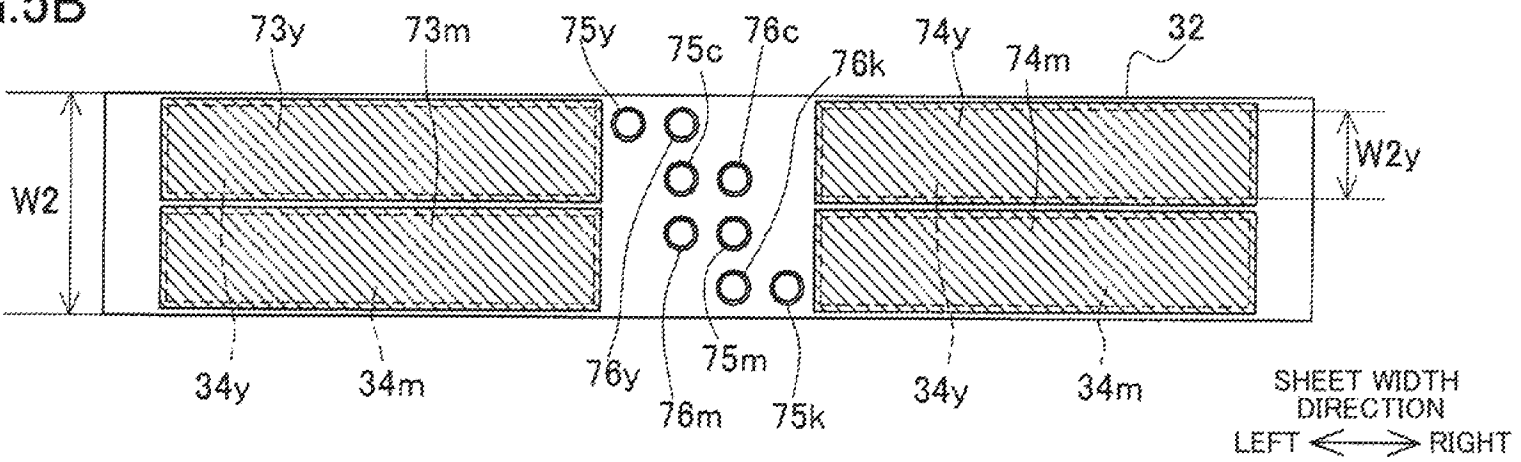
FIG. 5B is a plan view of a damper member.

As illustrated in FIGS. 4 and 5B, four connectors 75 and four connectors 76 are disposed on a central portion of the upper wall 69 in the front and rear direction. Four tubes 47 are attached to the respective connectors 75. Four tubes 72 are attached to the respective connectors 76. Each of the connectors 75, 76 has an opening in its upper surface. As illustrated in FIG. 3, a communication passage 77*y* extends downward from the connector 75*y* through the damper chamber 34*y* to the opening 43*y* of the supply chamber 33*y*. A tube defining the communication passage 77*y* is narrow, and this communication passage 77*y* does not inhibit a flow of the ink in the damper chamber 34*y* in the right and left direction. The connector 76*y* communicates with the opening 68*y* of the damper chamber 34*y*.

The constructions of the damper chambers 34 for the other ink colors are generally similar to that of the damper chamber 34*y*. However, as illustrated in FIG. 3, the resin films 73*c*, 74*c* of the damper chamber 34*c* are formed in the lower wall 78 of the damper member 32. The construction of the damper chamber 34*k* is similar to that of the damper chamber 34*c*. It is noted that FIG. 3 omits illustration of, e.g., the communication passages extending from the damper chamber 34*c* to the sub-tank 12*c*.

Details of Connections Among Components

There will be next explained details of a connection relationship among the components with reference to FIG. 3. The following description will be provided for the ink passages for the yellow ink by way of example.

The supply chamber 33*y* is connected to the damper chamber 34*y* by the communication passages 45*y*, 46*y*. That is, the openings 41*y*, 42*y* of the supply chamber 33*y* communicate with the respective openings 66*y*, 67*y* of the damper chamber 34*y* through the respective communication passages 45*y*, 46*y*. The supply chamber 33*y* is connected to the sub-tank 12*y* by the communication passage 77*y* and the tube 47*y*. That is, the opening 43*y* of the supply chamber 33*y* communicates with the sub-tank 12*y* through the communication passage 77*y* and the tube 47*y* attached to the connector 75*y*.

As thus described, the supply chamber 33*y* has the opening 43*y* directly communicating with the sub-tank 12*y* without communicating with the damper chamber 34*y*, in addition to the openings 41*y*, 42*y* communicating with the damper chamber 34*y*. That is, this printer 1 is not configured such that the damper chamber 34*y* is disposed between the sub-tank 12*y* and the supply chamber 33*y*.

The ink passages for the other ink colors also have the above-described connection relationship among the components. Focusing on the supply chamber 33*c*, for example, the openings 41*c*, 42*c* communicate with the respective openings 66*c*, 67*c* of the damper chamber 34*c*. The opening 43*c* different from the openings 41*c*, 42*c* communicates with the sub-tank 12*c*. The ink passages for the magenta ink and the black ink have the similar construction.

The damper chamber 34*y* is connected to the sub-tank 12*y* by tubes 71*y*, 72*y*. A diaphragm pump 13*y* is provided between the damper chamber 34*y* and the sub-tank 12*y*. That is, the opening 68*y* of the damper chamber 34*y* communicates through the tube 72*y* with an outlet 84 of the diaphragm pump 13*y*, which will be described below. The sub-tank 12*y* is connected by the tube 71*y* to an inlet 83 of the diaphragm pump 13*y*, which will be described below. The sub-tank 12*y* is connected to a main tank 11*y* by a tube 40*y*.

As thus described, the supply chamber 33*y* is connected to the damper chamber 34*y* and the sub-tank 12*y*, and the damper chamber 34*y* is connected to the sub-tank 12*y*. This construction forms a circulation passage in which the liquid having flowed from the sub-tank 12*y* flows back to the sub-tank 12*y* through the damper chamber 34*y* and the supply chamber 33*y*. The ink passages for the other colors also have the connection relationship described above.

Constructions of Diaphragm Pump

Figure 6C:
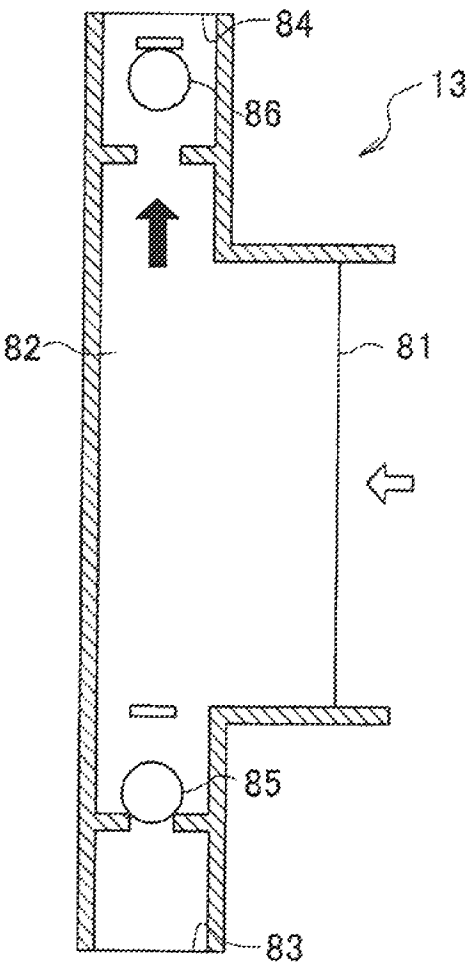
FIGS. 6A-6C are schematic cross-sectional views of a diaphragm pump.
Figure 6B:
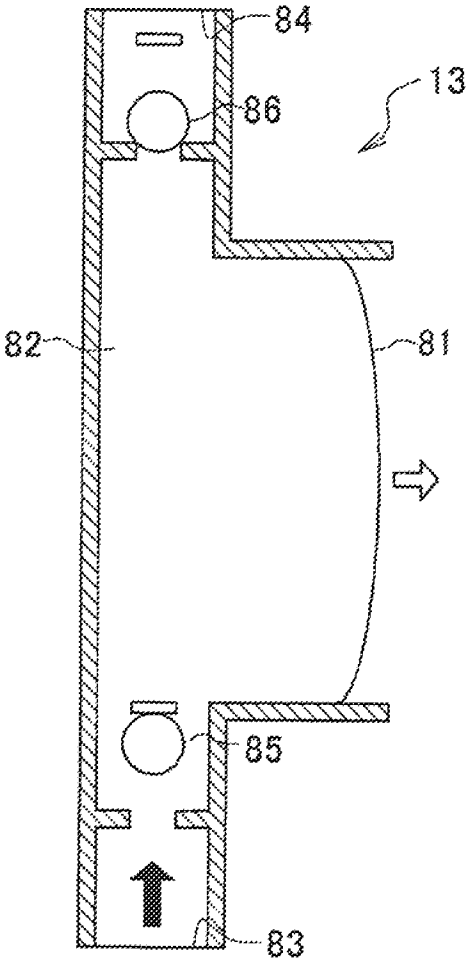
Figure 6A:
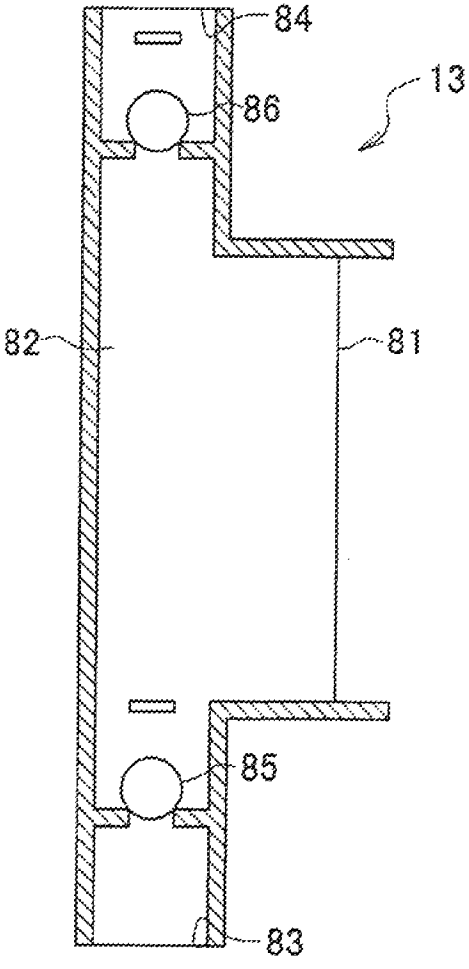

There will be next explained the construction of each of the diaphragm pumps 13 with reference to FIGS. 6A-6C. The diaphragm pump 13 includes: a pressure chamber 82 having a diaphragm 81; the inlet 83; the outlet 84; a check ball 85 disposed near the inlet 83; and a check ball 86 disposed near the outlet 84. As described above, the inlet 83 is connected to the sub-tank 12 by the tube 71, and the outlet 84 is connected to the damper chamber 34 by the tube 72. The diaphragm pump 13 is connected to a pump shaft, not illustrated.

When the diaphragm pump 13 is not operated, as illustrated in FIG. 6A, the inlet 83 and the outlet 84 are respectively closed by the check balls 85, 86. When the diaphragm pump 13 is operated, the pump shaft vibrates the diaphragm 81. As illustrated in FIG. 6B, when the diaphragm 81 is deformed so as to protrude, the pressure in the pressure chamber 82 lowers, so that the check balls 85, 86 are moved toward the pressure chamber 82 so as to close the outlet 84 and open the inlet 83, causing the ink to flow into the pressure chamber 82. As illustrated in FIG. 6C, when the diaphragm 81 is deformed back to its original shape, the pressure in the pressure chamber 82 rises, so that the check balls 85, 86 are moved away from the pressure chamber 82 so as to close the inlet 83 and open the outlet 84, causing the ink to flow toward the damper chamber 34. In this construction, the direction of the ink flow caused by the diaphragm pump 13 is fixed to the direction directed from the sub-tank 12 toward the damper chamber 34.

Ink Flow in Ink Passages

The ink flows in the ink passages in two ways. One of the ways is a flow of the ink supplied from the sub-tank 12 to the supply chamber 33 during printing, i.e., ink ejection. The other of the ways is a flow of the ink back to the sub-tank 12 through the sub-tank 12, the damper chamber 34, and the supply chamber 33 in maintenance. That is, the other of the ways is a flow of the circulation of the ink in maintenance. First, the ink flow in printing will be described with reference to FIG. 7.

Figure 7:
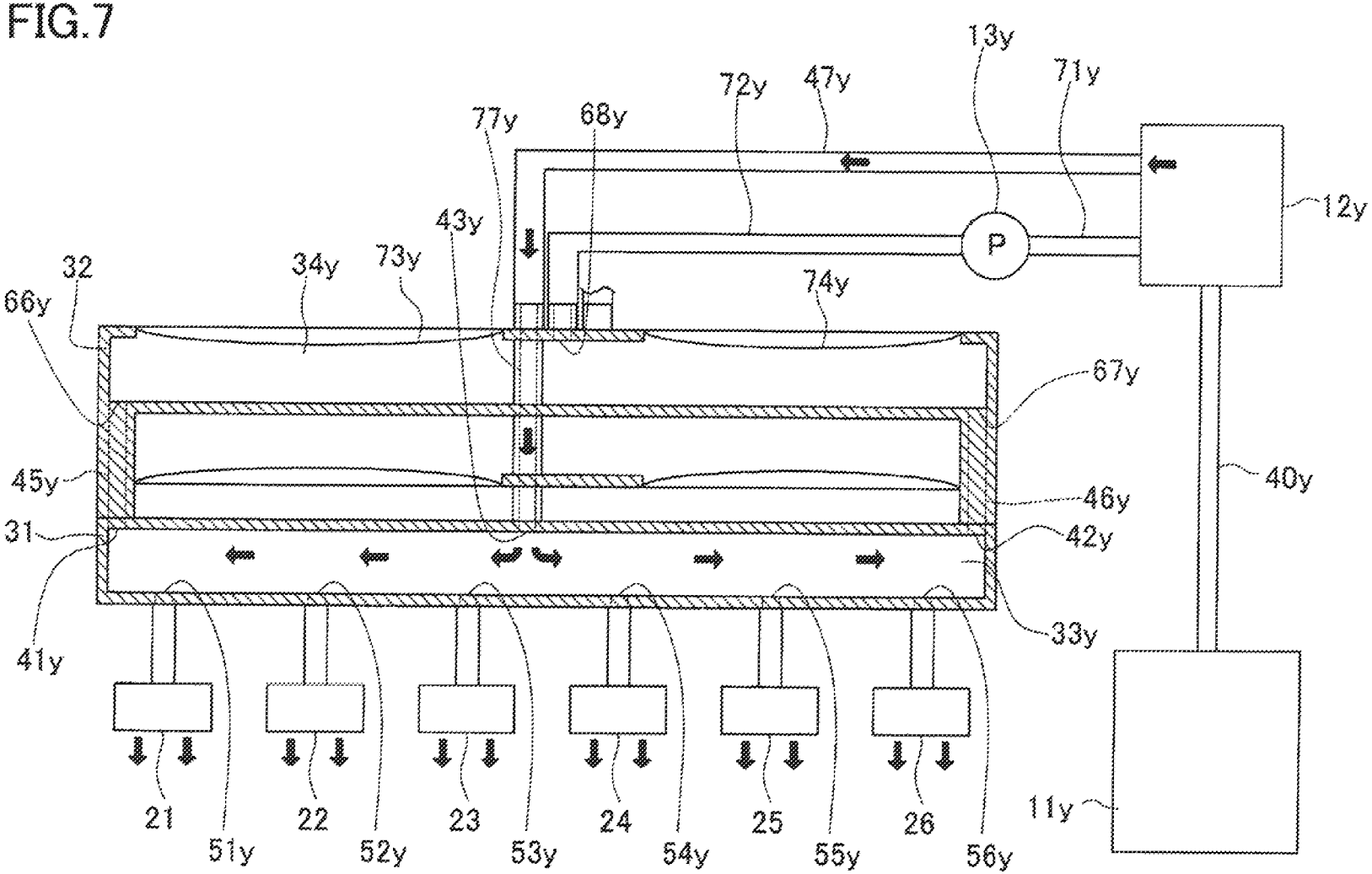
FIG. 7 is a conceptual view illustrating ink flow during printing.

FIG. 7 is a conceptual view illustrating a flow of the yellow ink in printing. The diaphragm pump 13*y* is not operated during printing to prevent the ink from flowing from the sub-tank 12*y* into the damper chamber 34*y*. The supply chamber 33*y* and the damper chamber 34*y* are filled with the ink. In printing, the controller 7 controls the ink-jet head 4 to eject the ink from the ejection modules 21-26. When the ink is consumed by this ejection, the ink stored in the sub-tank 12*y* is supplied through the tube 47*y* and the communication passage 77*y* to the central portion of the supply chamber 33*y* in the right and left direction. As a result, the supply chamber 33*y* is replenished with the ink. This ink flow is similar to flows of the inks of the other colors.

When the pressure of the ink in the supply chamber 33 is changed in printing, the resin films 73, 74 of the damper chamber 34 relieve the change of ink pressure as described above. Here, the resin films 73, 74 permit passage of gas therethrough, which may cause increase in viscosity of the ink and/or generation of air bubbles. Flow of the high-viscosity ink or the air bubbles into the ejection modules 21-26 may cause failure of ink ejection from the nozzles. If the damper chamber 34 is disposed between the sub-tank 12 and the supply chamber 33, all the high-viscosity ink flows into the ejection modules 21-26.

In the present embodiment, however, the openings 41, 42 of the supply chamber 33 of the ink supply unit 30 communicate with the damper chamber 34, and the opening 43 communicates with the sub-tank 12 independently of the communication of the openings 41, 42 with the damper chamber 34. That is, this printer 1 is not configured such that the damper chamber 34 is disposed between the sub-tank 12 and the supply chamber 33. Accordingly, even if increase in viscosity of the ink and/or generation of the air bubbles have occurred in the damper chamber 34, it is possible to make it more difficult for the high-viscosity ink and/or the air bubbles to flow into the ejection modules 21-26 in ink ejection from the ejection modules 21-26.

The openings 51-53 communicating with the respective ejection modules 21-23 are formed between the opening 41 and the opening 43 of the supply chamber 33. The openings 54-56 communicating with the respective ejection modules 24-26 are formed between the opening 42 and the opening 43. When an amount of ink consumption in the ejection modules 21-26 is large, supply of the ink from the sub-tank 12 to the ejection modules 21-26 cannot keep up with the ink consumption, leading to a significant drop of the ink pressure in the supply chamber 33. In the present embodiment, however, since the openings 51-56 are formed between the opening 41 and the opening 43 and between the opening 42 and the opening 43, the ink is also temporarily supplied from the damper chamber 34 to the supply chamber 33 via the openings 41, 42. This ink supply reduces the drop of the ink pressure in the supply chamber 33.

The supplied ink is prone to flow to right and left end portions of the supply chamber 33 later than to its central portion. In the present embodiment, the openings 42, 41 are formed at the respective right and left end portions of the supply chamber 33. Thus, the ink is also supplied from the damper chamber 34 via the end portions of the supply chamber 33, resulting in reduction in the drop of the liquid pressure in the supply chamber 33.

Figure 8:
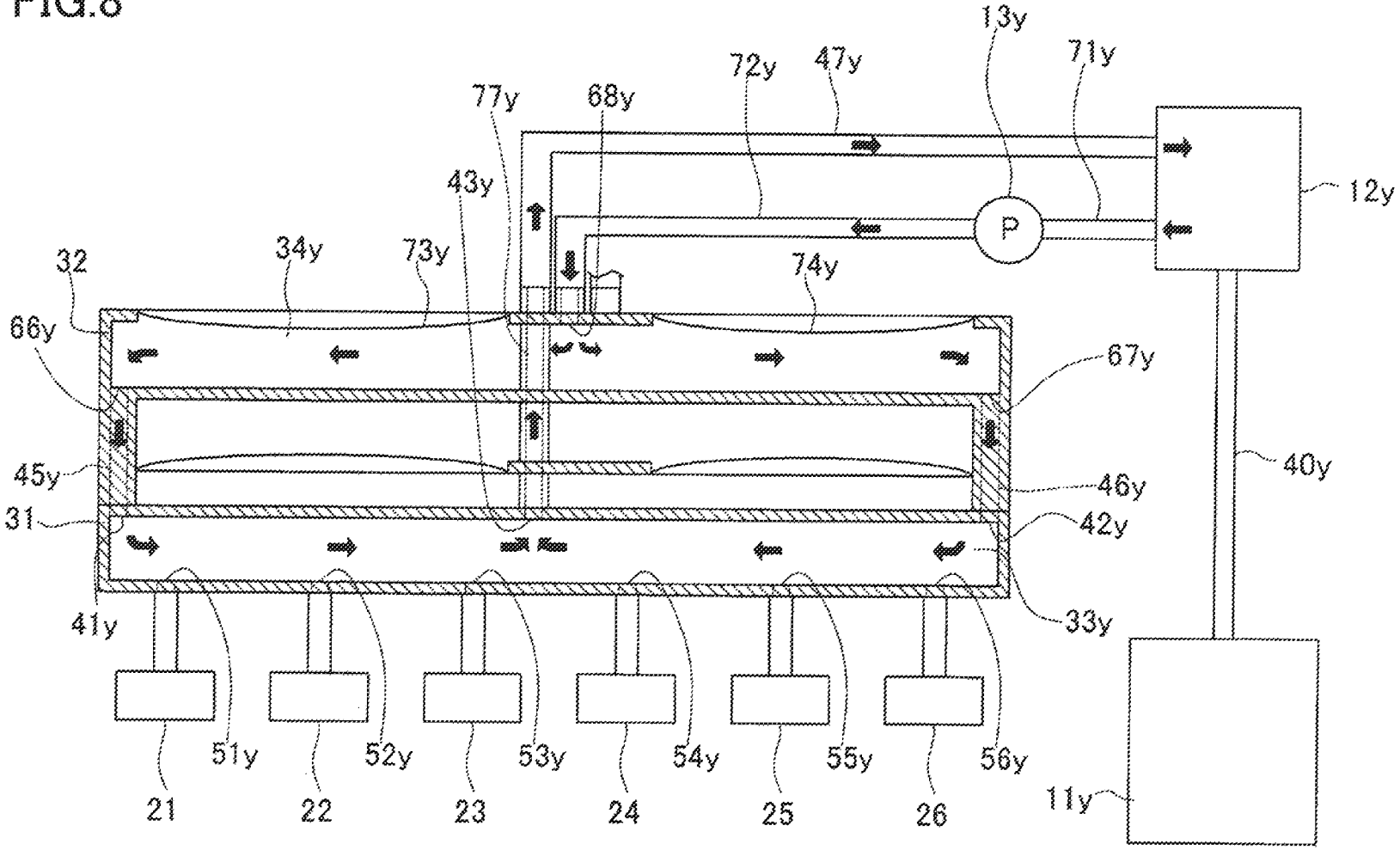
FIG. 8 is a conceptual view illustrating ink flow during maintenance.

There will be next explained the ink flow in maintenance with reference to FIG. 8. A lapse of time causes increase in viscosity of the ink in the damper chamber 34 and generation of air bubbles in the damper chamber 34. In particular, in the present embodiment, since an amount of consumption of the ink in the damper chamber 34 is small even in printing, it is assumed that the damper chamber 34 contains the ink whose viscosity has increased due to non-use for a long time. Although this printer 1 is configured such that the ink in the damper chamber 34 does not easily flow into the ejection modules 21-26, ejection failure may occur if the high-viscosity ink is supplied to the ejection modules 21-26 and used for printing. To solve this problem, in the present embodiment, maintenance is performed by circulating the ink in the circulation passage to replace the ink in the damper chamber 34.

FIG. 8 is a conceptual view illustrating a flow of the yellow ink in maintenance. The controller 7 actuates the diaphragm pump 13*y* in a state in which printing is not performed, i.e., in a state in which the ink is not ejected from the ejection modules 21-26. This actuation is performed when a predetermined period is elapsed from the previous maintenance, for example. When operated, the diaphragm pump 13*y* forces the ink from the sub-tank 12*y* through the tube 72*y* to the central portion of the damper chamber 34*y* in the right and left direction. High-viscosity ink and air bubbles in the damper chamber 34*y* are pushed rightward and leftward by the forced ink and transferred into the supply chamber 33*y* via the communication passages 45*y*, 46*y*. The transferred high-viscosity ink and air bubbles flow in the supply chamber 33*y*, then flow out of the supply chamber 33*y* from the opening 43*y* formed in the central portion of the supply chamber 33*y* in the right and left direction, finally flow back to the sub-tank 12*y* through the communication passage 77*y* and the tube 47*y*. Thus, the direction of the ink flow in printing and the direction of the ink flow in maintenance are reverse from each other.

With this maintenance, new ink whose viscosity has not increased is supplied to the damper chamber 34*y*. This ink flow is similar to flows of the inks of the other colors.

As described above, the circulation passage is formed in which the ink flows back to the sub-tank 12 through the sub-tank 12, the damper chamber 34, and the supply chamber 33. The diaphragm pump 13 disposed between the sub-tank 12 and the damper chamber 34 circulates the ink in the circulation passage to discharge high-viscosity ink and air bubbles from the damper chamber 34. This construction reduces inflows of the high-viscosity ink and air bubbles into the ejection modules 21-26 in ink ejection from the ejection modules 21-26.

The diaphragm pump 13 preferably forces the ink at a high pressure in maintenance in order to reliably discharge high-viscosity ink and air bubbles from the damper chamber 34. If the ink is transferred from the sub-tank 12 toward the supply chamber 33, however, the pressure of the ink may excessively rise in the supply chamber 33 just after the forcing of the ink from the diaphragm pump 13, leading to leakage of the ink from the ejection modules 21-26. In the present embodiment, however, the ink is circulated in maintenance in the direction reverse to that in printing, that is, the ink is circulated in maintenance in the order of the sub-tank 12, the damper chamber 34, the supply chamber 33, and the sub-tank 12. In this case, the ink leakage is prevented because the pressure in the supply chamber 33 is low due to pressure loss caused when the ink passes through the openings 41, 42 and the like.

The ink gets hard to flow if the area of the supply chamber 33 in cross section orthogonal to the right and left direction at the region located between the opening 43 and each of the openings 51-56 in the right and left direction. As a result, the pressure of the ink having flowed from the openings 41, 42 becomes high at a position near the openings 51-56, which may lead to leakage of the ink from the ejection modules 21-26. In the present embodiment, however, the above-described cross-sectional area is large at the region between the opening 43 and each of the supply openings in the right and left direction. Thus, the ink flow in the supply chamber 33 is not easily hindered, thereby avoiding the ink leakage from the ejection modules 21-26.

The diaphragm pump 13 includes the check ball 85 near the inlet 83 and the check ball 86 near the outlet 84. Thus, the inlet 83 and the outlet 84 are respectively closed by the check ball 85 and the check ball 86 at rest of the diaphragm pump 13, so that the ink does not flow through the tubes 71, 72. Accordingly, it is possible to prevent the ink from flowing from the sub-tank 12 to the damper chamber 34 in ink ejection.

Each of the one end portion and the other end portion of the damper chamber 34 is connected to the supply chamber 33. That is, the end portions of the damper chamber 34 are not blind. This construction enables smooth circulation of the ink in the damper chamber 34.

The wall defining the damper chamber 34 is at least partly constituted by the resin films 73, 74. With this construction, the changes of the ink pressure in the supply chamber 33 are effectively reduced, but the resin films 73, 74 permit passage of gas therethrough, which may cause increase in viscosity of the ink and generation of the air bubbles. In the present embodiment, the printer 1 is not configured such that the damper chamber 34 is disposed between the sub-tank 12 and the supply chamber 33, making it more difficult for the high-viscosity ink and/or the air bubbles to flow into the ejection modules 21-26 in the ejection of the liquid from the ejection modules 21-26.

If the supply chamber 33 is situated above the damper chamber 34, air having entered the damper chamber 34 through the resin films 73, 74 may become air bubbles and flow into the supply chamber 33. In the present embodiment, the damper chamber 34 is disposed above the supply chamber 33, preventing the air bubbles from flowing into the supply chamber 33.

While the supply chamber 33*y* and the supply chamber 33*c* are arranged in the front and rear direction, the damper chamber 34*y* and the damper chamber 34*c* are not arranged in the front and rear direction but overlap each other in the up and down direction. Accordingly, the total area of the two supply chambers 33 is provided for each of the damper chambers 34, enabling increase in the area of the resin films 73, 74.

The damper chamber 34*y* is situated above the supply chamber 33*y*, and the openings 41*y*, 42*y* of the supply chamber 33*y* are formed in the upper wall 44 of the supply member 31. Thus, the communication passage 45*y* connecting the supply chamber 33*y* and the damper chamber 34*y* to each other is short, resulting in compact layout. Likewise, the opening 43*y* is formed in the upper wall 44 of the supply member 31, resulting in compact layout.

In the embodiment described above, the printer 1 is one example of a liquid ejection apparatus. The ink is one example of liquid. The front and rear direction is one example of an arrangement direction. The right and left direction is one example of a longitudinal direction. Each of the sub-tanks 12 is one example of a tank. Each of the openings 41, 42 and the openings 41*y*, 42*y* is one example of a first opening. Each of the opening 43 and 43*y* is one example of a second opening. Each of the communication passages 45*y*, 46*y* is one example of a first connection passage. Each of the communication passage 77*y* and the tube 47*y* is one example of a second connection passage. Each of the openings 51-56 is one example of a supply opening. Each of the diaphragm pumps 13 is one example of a pump. Each of the tubes 71, 72 is one example of a liquid passage. The check ball 85 is one example of an inlet valve. The check ball 86 is one example of an outlet valve.

The yellow ink is one example of first liquid. The cyan ink is one example of second liquid. The sub-tank 12*y* is one example of a first tank. The sub-tank 12*c* is one example of a second tank. The supply chamber 33*y* is one example of a first supply chamber. The supply chamber 33*c* is one example of a second supply chamber. The damper chamber 34*y* is one example of a first damper chamber. The damper chamber 34*c* is one example of a second damper chamber. Each of the openings 41*c*, 42*c* is one example of a third opening. The opening 43*c* is one example of a fourth opening. Each of the resin films 73*y*, 74*y* is one example of a first resin film. Each of the resin films 73*c*, 74*c* is one example of a second resin film. Each of the communication passages 45*c*, 46*c* is one example of a third connection passage. Each of the communication passage 77*c* and the tube 47*c* is one example of a fourth connection passage. The ink supply unit 30 is one example of a liquid supply unit.

There will be next explained modifications of the above-described embodiment. It is noted that the same reference numerals as used in the above-described embodiment are used to designate the corresponding elements of the modifications, and an explanation of which is dispensed with.

Figure 9:
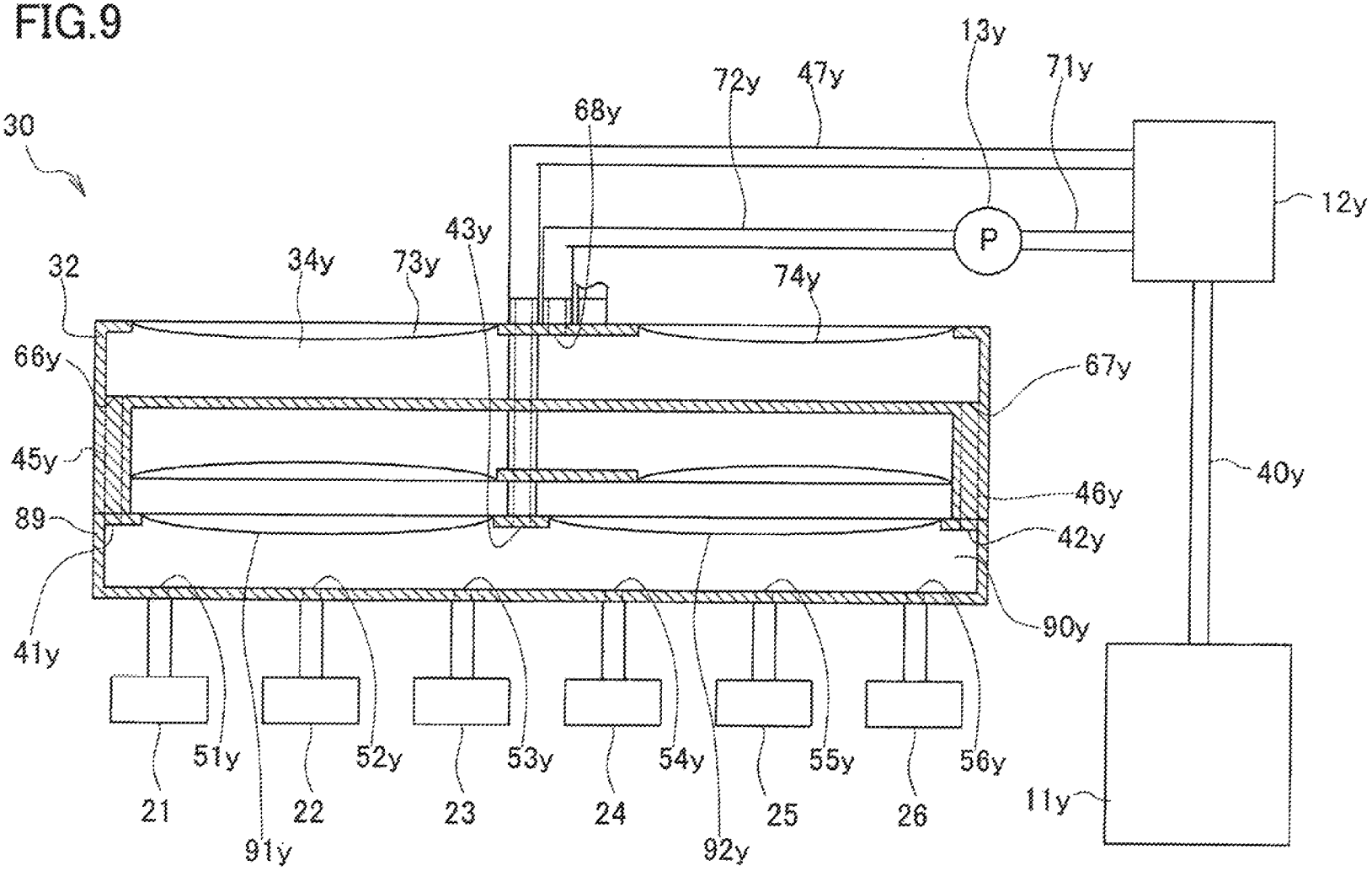
FIG. 9 is a view illustrating ejection modules and an ink passage for one color in a modification.

In a modification, the wall defining the supply chamber may be partly constituted by a resin film. FIG. 9 illustrates a supply member 89 having a supply chamber 90*y*. A portion of the supply chamber 90*y* which is located between the opening 41*y* and the opening 43*y* is defined by a resin film 91*y*. A portion of the supply chamber 90*y* which is located between the opening 42*y* and the opening 43*y* is defined by a resin film 92*y*. As in the above-described embodiment, the width of the damper chamber 34*y* in the front and rear direction is about twice the width of the supply chamber 90*y* in the front and rear direction. That is, the total area of the resin films 91*y*, 92*y* of the supply chamber 90*y* is less than that of the resin films 73*y*, 74*y* of the damper chamber 34*y*.

While the resin films 91*y*, 92*y* relieve changes of the pressure of the yellow ink in the supply chamber 90*y* in printing, increase in viscosity of the ink and generation of air bubbles may occur in the supply chamber 90*y*. However, since the total area of the resin films 91*y*, 92*y* is less than that of the resin films 73*y*, 74*y* of the damper chamber 34*y*, the increase in viscosity of the ink and the like have smaller effects. That is, in this modification, the supply chamber 90*y* has the function of relieving the changes of the ink pressure like the damper chamber 34*y*, but the damper chamber 34*y* defined by the resin films 73*y*, 74*y* having a relatively large total area is one example of a first damper chamber. This construction achieves an effect of reducing a flow of the high-viscosity ink into the supply chamber 90*y*. In this modification, each of the resin films 91*y*, 92*y* is one example of a third resin film.

The constructions of the supply member 31 and the damper member 32 are not limited to those in the above-described embodiment. For example, the width W1 of the supply member 31 in the front and rear direction and the width W2 of the damper member 32 in the front and rear direction may not be substantially equal to each other. Each of the supply member 31 and the damper member 32 may not have the substantially rectangular parallelepiped shape.

The four supply chambers 33 may be constituted by different members. Likewise, the four damper chambers 34 may be constituted by different members.

Figure 10:
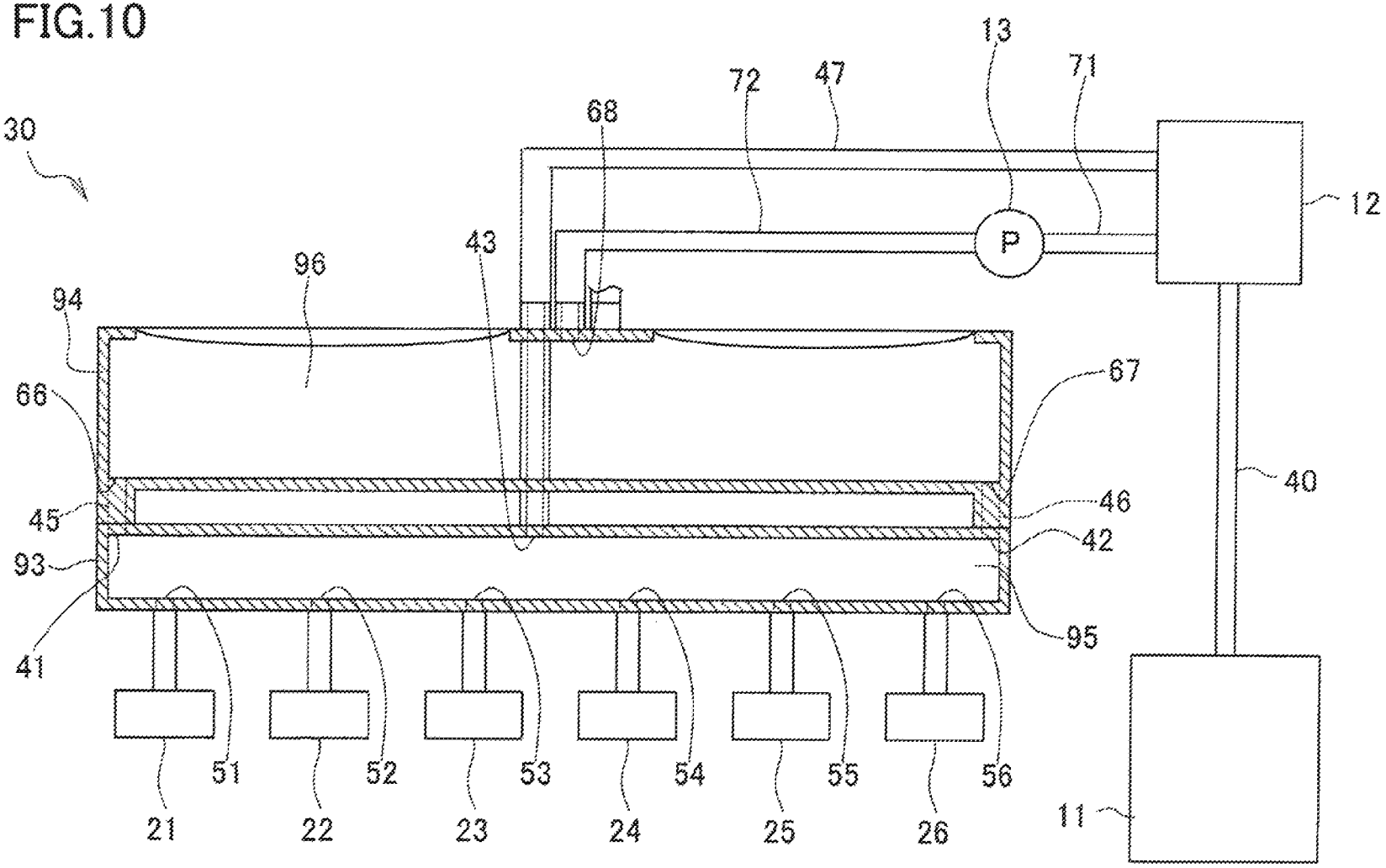
FIG. 10 is a view illustrating ejection modules and an ink passage for one color in another modification.

The colors of the inks are not limited to the four colors. FIG. 10 illustrates a damper member 94 is not partitioned into an upper portion and a lower portion. Though not illustrated, a supply member 93 is not partitioned into a front portion and a rear portion and has only one supply chamber 95. Likewise, though not illustrated, the damper member 94 is not partitioned into a front portion and a rear portion and has only one damper chamber 96.

Figure 11:
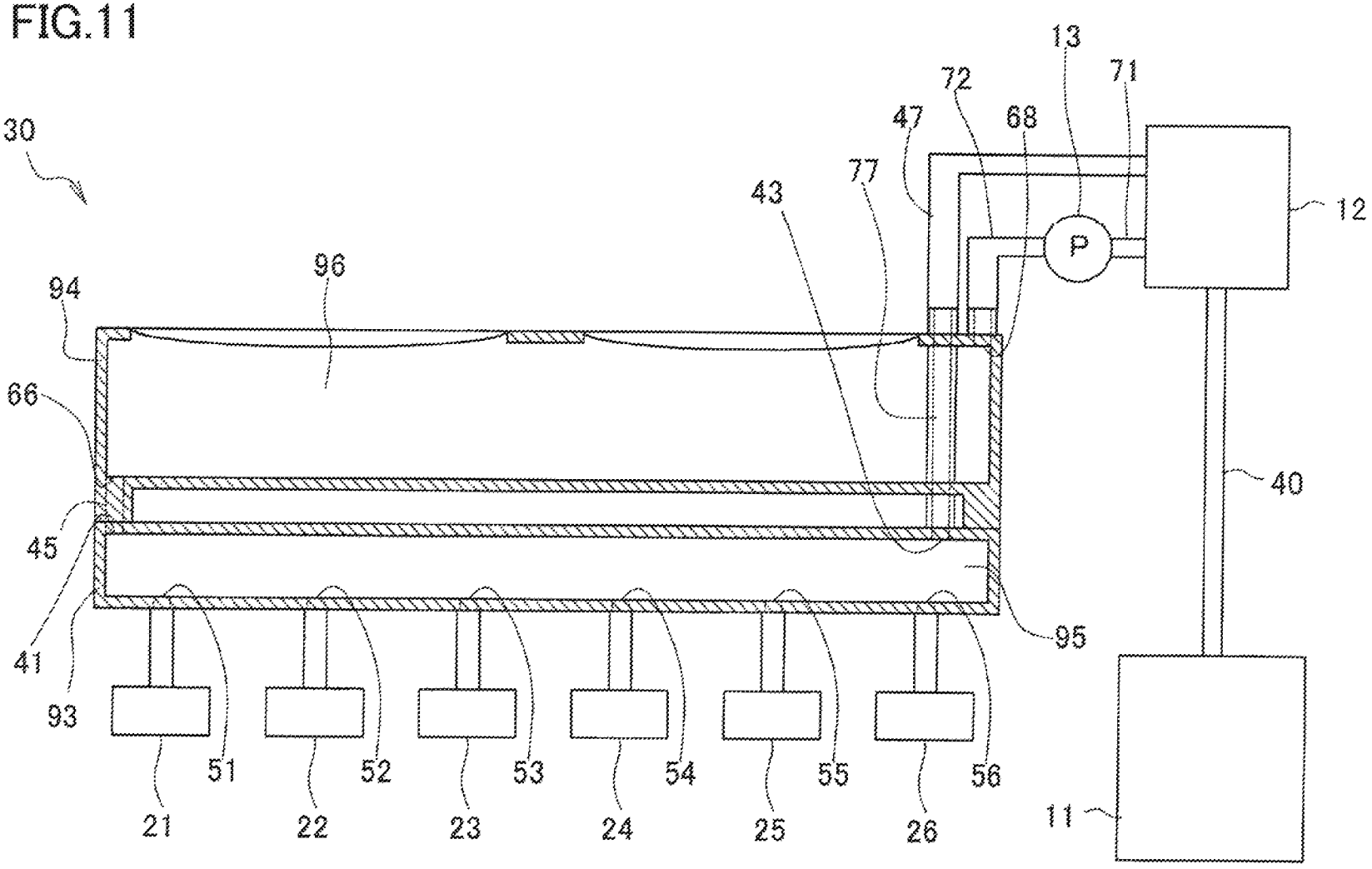
FIG. 11 is a view illustrating ejection modules and an ink passage for one color in yet another modification.

The positions of the openings of the supply chamber and the damper chamber may be changed. In the supply chamber 95 illustrated in FIG. 11, the opening 41 is formed in a left end portion of the supply chamber 95, and the opening 43 is formed in a right end portion of the supply chamber 95. The opening 68 is formed in a right end portion of the damper chamber 96. That is, a left end portion of the damper chamber 96 and the supply chamber 95 are connected to each other, and the right end portion of the damper chamber 96 and the sub-tank 12 are connected to each other. The ink is supplied from the damper chamber 96 to the left end portion of the supply chamber 95 to relieve the drop of the ink pressure in the supply chamber. Also in this construction, the end portions of the damper chamber 96 are not blind. Thus, when the diaphragm pump 13 is actuated, all the ink in the damper chamber 96 is discharged without remaining, so that high-viscosity liquid and air bubbles are circulated and transferred back to the sub-tank 12. Accordingly, it is possible to prevent the high-viscosity liquid and the air bubbles from flowing into the ejection modules 21-26 in liquid ejection from the ejection modules 21-26.

Figure 12:
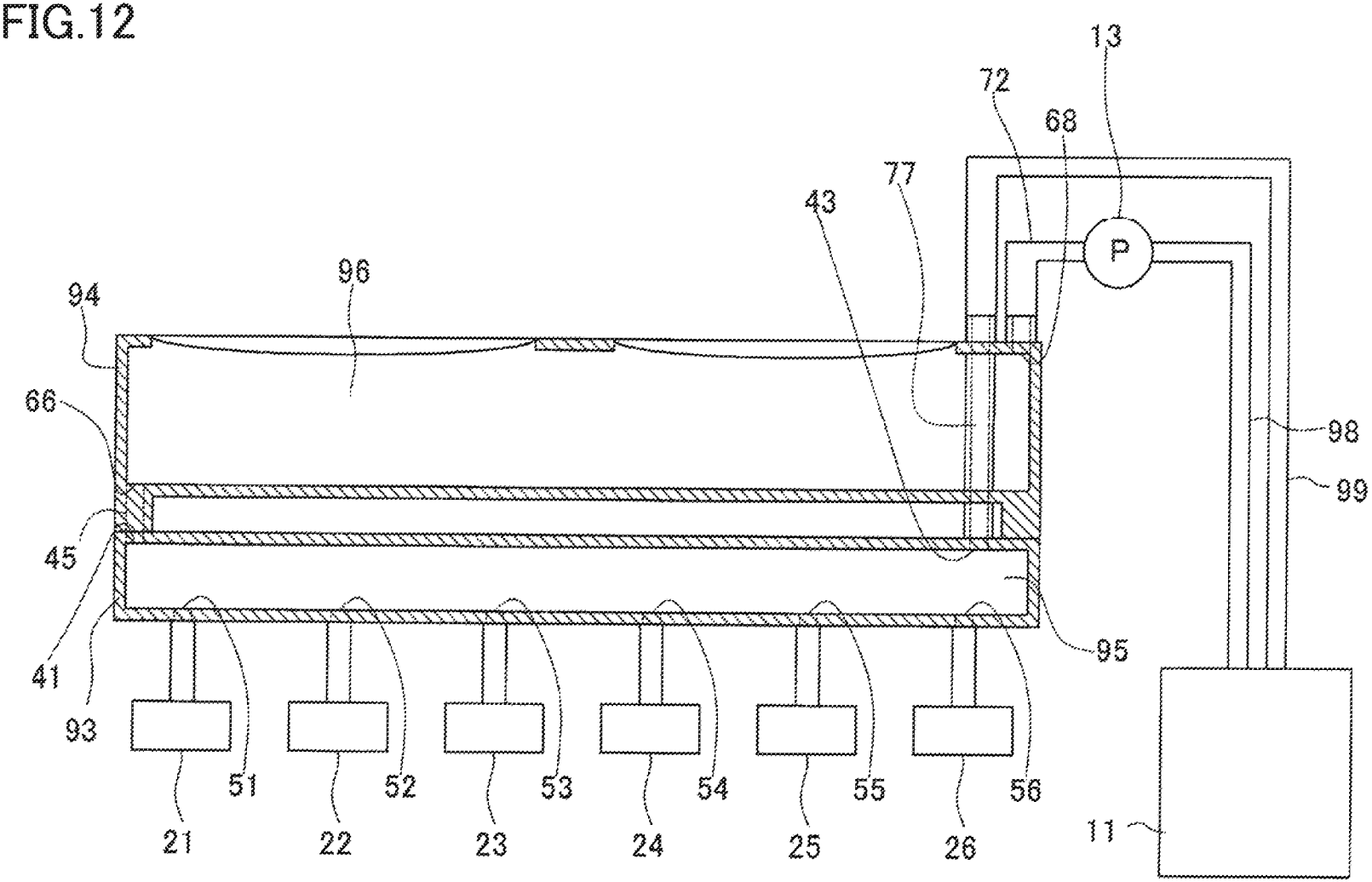
FIG. 12 is a view illustrating ejection modules and an ink passage for one color in yet another modification.

The sub-tank may not be provided between the ink-jet head 4 and the main tank 11. In FIG. 12, the main tank 11 is connected to the diaphragm pump 13 by a tube 98 and to the supply chamber 95 by a tube 99. With this construction, the ink is directly supplied from the main tank 11 to the supply chamber 95 in printing. In maintenance, the diaphragm pump 13 forces the ink from the main tank 11 to the damper chamber 96. In this modification, the main tank 11 is one example of the tank.

The direction of the ink flow in maintenance may coincide with the direction of the ink flow in printing. For example, the printer 1 may be constructed such that the inlet 83 of the diaphragm pump 13 is connected to the tube 72, and the outlet 84 is connected to the tube 71. In this construction, the diaphragm pump 13 sucks the ink from the damper chamber 96 and transfers the ink toward the sub-tank 12, so that the ink in the sub-tank is transferred toward the supply chamber 95.

The pump is not limited to the diaphragm pump 13. For example, a suction pump may be used to suck high-viscosity ink from the damper chamber 34 and the like to circulate the ink.

The openings 66, 67 of the damper chamber 34 may not be formed at the opposite end portions of the damper chamber 34 in the right and left direction, for example.

Each of the openings 51-56 respectively communicating with the ejection modules 21-26 may be formed between the opening 41 and the opening 43 or between the opening 42 and the opening 43.

The ink supply unit 30 may not include the diaphragm pump 13 so as not to circulate the ink. Also in this construction, since the damper chamber 96 is not disposed between the sub-tank 12 and the supply chamber 95, it is possible to make it more difficult for the high-viscosity ink and/or the air bubbles to flow into the ejection modules 21-26.

In the above-described embodiment, the ink-jet head 4 is a line head that is not moved with respect to the recording sheet 100 during printing. However, the ink-jet head 4 may be a serial head configured to eject the ink while moving in the right and left direction.

The present disclosure has been applied to the printer configured to eject the ink to perform printing, but the present disclosure is not limited to this configuration. For example, the present disclosure may be applied to liquid ejection apparatuses configured to eject liquid other than the ink, such as materials of wiring patterns for wiring substrates.

What is claimed is:

1. A liquid ejection apparatus, comprising:

an ejection module;

a supply chamber connected to the ejection module and to a tank configured to store liquid; and a damper chamber connected to the supply chamber, wherein the supply chamber comprises: a first opening communicating with the damper chamber; and a second opening communicating with the tank, wherein the damper chamber comprises a third opening communicating with the tank, wherein the supply chamber is not defined by any flexible films, wherein the liquid ejection apparatus further comprises:

a first connection passage connecting the first opening and the damper chamber to each other and causing the supply chamber and the damper chamber to communicate with each other at all times, a second connecting passage connecting the tank and the second opening to each other without intervention of any damper chambers between the supply chamber and the tank so as to flow the liquid in the tank to the supply chamber through the second connecting passage, a liquid passage connecting the third opening of the damper chamber and the tank to each other; and a pump disposed at a portion of the liquid passage, wherein the pump comprises a pressure chamber comprising a diaphragm, an inlet valve, and an outlet valve.

2. The liquid ejection apparatus according to claim 1,
wherein the supply chamber is elongated in a first direction, and
wherein the first opening is located at an end portion of the supply chamber in the first direction.

3. The liquid ejection apparatus according to claim 1,
wherein the supply chamber is elongated in a first direction,
wherein the first opening is located at a first end portion of the supply chamber in the first direction, and
wherein the second opening is located at a second end portion of the supply chamber in the first direction.

4. The liquid ejection apparatus according to claim 1,
wherein a first end portion of the damper chamber is connected to the supply chamber, and
wherein a second end portion of the damper chamber is connected to the tank.

5. The liquid ejection apparatus according to claim 1,
wherein each of a first end portion and a second end portion of the damper chamber is connected to the supply chamber, and
wherein a portion of the damper chamber which is located between the first end portion and the second end portion is connected to the tank.

6. The liquid ejection apparatus according to claim 1, wherein at least a portion of a wall defining the damper chamber is constituted by a resin film.

7. The liquid ejection apparatus according to claim 1, wherein the damper chamber is disposed above the supply chamber.

8. A liquid ejection apparatus, comprising:
an ejection module;
a first supply chamber connected to the ejection module and to a first tank configured to store first liquid;
a first damper chamber connected to the first supply chamber;
a second supply chamber connected to the ejection module and to a second tank configured to second liquid; and
a second damper chamber connected to the second supply chamber,
wherein each of the first supply chamber, the second supply chamber, the first damper chamber, and the second damper chamber is elongated in a first direction as a longitudinal direction,
wherein the first supply chamber comprises: a first opening communicating with the first damper chamber; and a second opening communicating with the first tank,
wherein the second supply chamber comprises: a third opening communicating with the second damper chamber; and a fourth opening communicating with the second tank,
wherein at least a portion of a wall defining the first damper chamber is constituted by a first resin film,
wherein at least a portion of a wall defining the second damper chamber is constituted by a second resin film,
wherein the first supply chamber and the first damper chamber overlap each other when viewed in an up and down direction,
wherein the first supply chamber and the second supply chamber are arranged in an arrangement direction orthogonal to each of the longitudinal direction and the up and down direction, and
wherein the first damper chamber and the second damper chamber overlap each other when viewed in the up and down direction.

9. The liquid ejection apparatus according to claim 8, further comprising:
a first connection passage connecting the first opening and the first damper chamber to each other;
a second connection passage connecting the second opening and the first tank to each other;
a third connection passage connecting the third opening and the second damper chamber to each other; and
a fourth connection passage connecting the fourth opening and the second tank.

10. The liquid ejection apparatus according to claim 8,
wherein the first damper chamber is disposed above the first supply chamber, and
wherein the first opening is formed in an upper wall defining the first supply chamber.

11. The liquid ejection apparatus according to claim 10, wherein the second opening is formed in the upper wall defining the first supply chamber.

12. The liquid ejection apparatus according to claim 11, wherein a portion of the upper wall defining the first supply chamber which portion is located between the first opening and the second opening in the first direction is constituted by a third resin film with an area that is less than an area of the first resin film.

13. A liquid ejection apparatus, comprising:
an ejection module;
a supply chamber connected to the ejection module and to a tank configured to store liquid; and
a damper chamber connected to the supply chamber,
wherein the supply chamber comprises a first opening communicating with the damper chamber, and a second opening communicating with the tank,
wherein the damper chamber comprises a third opening communicating with the tank,
wherein the supply chamber is not defined by any flexible films,
wherein the supply chamber is elongated in a first direction,
wherein the supply chamber comprises a supply opening communicating with the ejection module, and the supply opening is located between the first opening and the second opening in the first direction, and
wherein a cross-sectional area of the supply chamber on a plane orthogonal to the first direction at a position located between the supply opening and the second opening in the first direction is greater than an area of the first opening.

14. A liquid ejection apparatus, comprising:
an ejection module;
a supply chamber connected to the ejection module and to a tank configured to store liquid;
a damper chamber connected to the supply chamber;
a liquid passage connecting the third opening of the damper chamber and the tank to each other; and
a pump disposed at a portion of the liquid passage,
wherein the supply chamber comprises a first opening communicating with the damper chamber; and a second opening communicating with the tank,
wherein the damper chamber comprises a third opening communicating with the tank,
wherein the supply chamber is not defined by any flexible films,
wherein each of a first end portion and a second end portion of the damper chamber is connected to the supply chamber, and wherein a portion of the damper chamber which is located between the first end portion and the second end portion is connected to the tank.

15. A liquid ejection apparatus, comprising:

an ejection module;

a supply chamber connected to the ejection module and to a tank configured to store liquid; and a damper chamber connected to the supply chamber, wherein the supply chamber comprises: a first opening communicating with the damper chamber; and a second opening communicating with the tank, wherein the damper chamber comprises a third opening communicating with the tank, wherein the liquid ejection apparatus further comprises a first connection passage connecting the first opening and the damper chamber to each other and causing the supply chamber and the damper chamber to communicate with each other at all times, and wherein the supply chamber comprises a supply opening communicating with the ejection module, and the supply opening is located between the first opening and the second opening.

* * * * *